US010618293B2

(12) United States Patent
Koshikawa et al.

(10) Patent No.: US 10,618,293 B2
(45) Date of Patent: Apr. 14, 2020

(54) LIQUID REPLENISHMENT CONTAINER AND LIQUID REPLENISHMENT SYSTEM

(71) Applicant: CANON KABUSHIKI KAISHA, Tokyo (JP)

(72) Inventors: Hiroshi Koshikawa, Yokohama (JP); Kenta Udagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/182,459

(22) Filed: Nov. 6, 2018

(65) Prior Publication Data

US 2019/0163091 A1 May 30, 2019

(30) Foreign Application Priority Data

Nov. 27, 2017 (JP) ..... 2017-226896

(51) Int. Cl.

| | |
|---|---|
| ***B65D 41/28*** | (2006.01) |
| ***B41J 2/175*** | (2006.01) |
| ***G03G 15/08*** | (2006.01) |
| *G03G 15/10* | (2006.01) |

(52) U.S. Cl.

CPC ..... *B41J 2/17509* (2013.01); *B65D 41/28* (2013.01); *G03G 15/0868* (2013.01); *G03G 15/0886* (2013.01); *G03G 15/104* (2013.01)

(58) Field of Classification Search

CPC ... B41J 2/17506; B41J 2/17509; B65D 41/30; B65D 41/28

See application file for complete search history.

(56) References Cited

U.S. PATENT DOCUMENTS

| | | | | |
|---|---|---|---|---|
| 6,145,972 | A | 11/2000 | Udagawa et al. | 347/86 |
| 6,244,695 | B1 | 6/2001 | Udagawa | 347/86 |
| 6,293,663 | B1 | 9/2001 | Koshikawa et al. | 347/86 |
| 6,350,025 | B1 | 2/2002 | Morita et al. | 347/86 |
| 6,382,783 | B1 | 5/2002 | Hayashi et al. | 347/85 |
| 6,382,786 | B2 | 5/2002 | Iwanaga et al. | 347/86 |
| 6,390,601 | B1 | 5/2002 | Morita et al. | 347/49 |
| 6,402,298 | B1 | 6/2002 | Nanjo et al. | 347/49 |
| 6,416,173 | B2 | 7/2002 | Kishida et al. | 347/86 |
| 6,419,349 | B1 | 7/2002 | Iwanaga et al. | 347/86 |
| 6,443,567 | B1 | 9/2002 | Hayashi et al. | 347/85 |
| 6,450,631 | B1 | 9/2002 | Hayashi et al. | 347/86 |
| 6,454,400 | B1 | 9/2002 | Morita et al. | 347/86 |
| 6,471,343 | B1 | 10/2002 | Shimizu et al. | 347/85 |
| 6,505,923 | B1 | 1/2003 | Yamamoto et al. | 347/85 |
| 6,511,167 | B1 | 1/2003 | Kitabatake et al. | 347/86 |
| 6,527,381 | B1 | 3/2003 | Udagawa et al. | 347/86 |
| 6,530,654 | B2 | 3/2003 | Kitabatake et al. | 347/86 |
| 6,540,342 | B2 | 4/2003 | Koshikawa et al. | 347/86 |
| 6,543,886 | B1 | 4/2003 | Hattori et al. | 347/85 |
| 6,550,898 | B2 | 4/2003 | Hayashi et al. | 347/85 |

(Continued)

FOREIGN PATENT DOCUMENTS

| | | | | |
|---|---|---|---|---|
| FR | 1401450 A | * | 6/1965 | B65D 41/28 |
| JP | 2015-178280 | | 10/2015 | |
| JP | 2016-203991 | | 12/2016 | |

*Primary Examiner* — Shelby L Fidler

(74) *Attorney, Agent, or Firm* — Venable LLP

(57) ABSTRACT

The ink adhesion surface sides of the plug member removed from the ink jet recording apparatus and the cap removed from the ink replenishment container are faced each other, superposed and attached so that the ink adhesion surfaces are not exposed to the outside.

8 Claims, 11 Drawing Sheets

(56) References Cited

U.S. PATENT DOCUMENTS

| | | | | |
|---|---|---|---|---|
| 6,598,963 | B1 | 7/2003 | Yamamoto et al. | 347/85 |
| 6,652,949 | B2 | 11/2003 | Iwanaga et al. | 428/65.9 |
| 6,655,542 | B2 | 12/2003 | Koshikawa et al. | 220/661 |
| 6,702,427 | B2 | 3/2004 | Shimizu et al. | 347/50 |
| 6,705,715 | B2 | 3/2004 | Morita et al. | 347/87 |
| 6,709,092 | B2 | 3/2004 | Hayashi et al. | 347/86 |
| 6,712,458 | B2 | 3/2004 | Hatasa et al. | 347/86 |
| 6,719,415 | B1 | 4/2004 | Hattori et al. | 347/86 |
| 6,742,857 | B2 | 6/2004 | Koshikawa et al. | 347/19 |
| 6,742,881 | B2 | 6/2004 | Kotaki et al. | 347/86 |
| 6,796,645 | B2 | 9/2004 | Hayashi et al. | 347/86 |
| 6,805,434 | B2 | 10/2004 | Hayashi et al. | 347/85 |
| 6,824,258 | B2 | 11/2004 | Yamamoto et al. | 347/86 |
| 6,851,798 | B2 | 2/2005 | Koshikawa et al. | 347/85 |
| 6,863,762 | B2 | 3/2005 | Sanada et al. | 156/180 |
| 6,877,848 | B2 | 4/2005 | Shimizu et al. | 347/86 |
| 6,921,161 | B2 | 7/2005 | Morita et al. | 347/86 |
| 7,434,921 | B2 | 10/2008 | Udagawa | 347/85 |
| 7,854,499 | B2 | 12/2010 | Udagawa | 347/86 |
| 8,002,397 | B2 | 8/2011 | Udagawa et al. | 347/86 |
| 8,087,762 | B2 | 1/2012 | Takemura et al. | 347/85 |
| 9,333,758 | B2 | 5/2016 | Koshikawa et al. | B41J 2/17523 |
| 9,375,938 | B2 | 6/2016 | Kondo et al. | B41J 2/1752 |
| 9,597,884 | B2 | 3/2017 | Nanjo et al. | B41J 2/17526 |
| 9,821,562 | B2 | 11/2017 | Nanjo et al. | B41J 2/17526 |
| 9,840,082 | B2 | 12/2017 | Nanjo et al. | B41J 2/17526 |
| 9,908,338 | B2 | 3/2018 | Koshikawa et al. | B41J 2/17559 |
| 9,994,037 | B2 | 6/2018 | Sakai | B41J 2/17596 |
| 2002/0113853 | A1 | 8/2002 | Hattori et al. | 347/86 |
| 2003/0038867 | A1 | 2/2003 | Yamamoto et al. | 347/86 |
| 2003/0043241 | A1 | 3/2003 | Hattori et al. | 347/86 |
| 2005/0011916 | A1* | 1/2005 | Battista | B41J 2/17509 222/576 |
| 2009/0278900 | A1 | 11/2009 | Kondo et al. | 347/85 |
| 2018/0015728 | A1 | 1/2018 | Nanjo et al. | B41J 2/17526 |
| 2019/0030903 | A1* | 1/2019 | Fukasawa | B41J 2/17523 |

* cited by examiner

LIQUID REPLENISHMENT CONTAINER AND LIQUID REPLENISHMENT SYSTEM

BACKGROUND OF THE INVENTION

Field of the Invention

The present invention relates to a liquid replenishment container for storing liquid ink replenished to a liquid reservoir container for reserving liquid ink supplied to a recording head of an ink jet recording apparatus, and a liquid replenishment system configured by including a liquid reservoir container and a liquid replenishment container.

Description of the Related Art

In recent years, as one form of an ink jet recording apparatus, an apparatus provided with a large-capacity liquid reservoir container (hereinafter referred to as a main tank for convenience) for reserving liquid ink, in which a configuration in which ink is supplied to a recording head on a carriage that moves and scans for recording via a tube is adopted, has been known. The main tank is provided with an ink inlet, and is configured so that, when the ink in the main tank is consumed, ink can be replenished from a liquid replenishment container (hereinafter referred to as an ink replenishment container for convenience) that stores ink for replenishment. A plug member is detachably attached to the ink inlet so as to prevent the ink in the main tank from leaking to the outside from the ink inlet. When replenishing ink, the plug member is removed, an ink replenishing port of the ink replenishment container is inserted into the ink inlet, and the necessary amount of ink is replenished. When ink remains in the ink replenishment container after ink replenishment, a cap is attached to the ink replenishing port to protect the ink replenishing port while preventing leakage of ink from the ink replenishing port (Japanese Patent Application Laid-Open Nos. 2015-178280 and 2016-203991).

In such an ink jet recording apparatus, when an ink replenishment operation is repeatedly performed, the inner surface of the ink inlet of the main tank and the surroundings thereof are gradually stained with ink. A plug member attached to such ink inlet is stained due to adhesion of ink to the contact surface with the ink inlet. Therefore, ink stain of the plug member removed during the replenishment operation may adhere to the surroundings or clothes and fingers of the operator. On the other hand, when the ink inlet to which ink adheres during the ink replenishment operation and the ink replenishing port of the ink replenishment container come into contact with each other, or the surroundings of the ink replenishing port are stained with ink due to ink dripping from the ink replenishing port after ink replenishment. By attaching the cap to the ink replenishing port stained with ink, the ink replenishing port can be protected from ink staining in a state where the cap is attached. However, ink adheres to a cap surface (referred to as a cap inner surface for convenience) covering the ink replenishing port. Therefore, ink may drip off from the cap inner surface removed during the replenishment operation, and the surroundings and the clothes and fingers of the operator may be stained, so that care is necessary for handling.

SUMMARY OF THE INVENTION

The liquid replenishment container of the present invention is a liquid replenishment container including a liquid replenishing port that can store liquid to be replenished to a liquid reservoir container and replenishes the liquid to the liquid reservoir container via a liquid inlet, the liquid reservoir container being configured for a plug member to be detachably attachable, being provided with the liquid inlet that enables replenishment of liquid from the outside, and reserving the liquid to be supplied to a recording head; and a cap configured to be detachably attachable to the liquid replenishing port; wherein it is possible to superpose a seal portion of the plug member contacting with the liquid inlet on a surface of the cap covering the liquid replenishing port with facing each other and attach it.

Further features of the present invention will become apparent from the following description of exemplary embodiments with reference to the attached drawings.

DESCRIPTION OF THE EMBODIMENTS

It is an object of the present invention to provide a liquid replenishment container and a liquid replenishment system that suppress ink contamination to surroundings and an operator by a plug member or a cap removed during ink replenishment operation.

Hereinafter, an embodiment of an ink replenishment container according to the present invention will be specifically described with reference to the drawings. The following embodiments show a preferred example of the present invention, and the present invention is not limited to these configurations. Various modified configurations may be naturally included as long as they satisfy the gist of the invention.

The present invention is based on the following idea. That is, ink adhesion surfaces of both a plug member removed from an ink inlet of a main tank (liquid reservoir container) and a cap removed from a replenishing port of an ink replenishment container are faced to each other, superposed, and attached. It is an idea that the ink-contaminated surface is not exposed to the outside thereby.

The ink-contaminated surface does not face outward, so that it is possible to restrict a situation such that ink adheres to the surroundings.

First Embodiment

Figure 1:
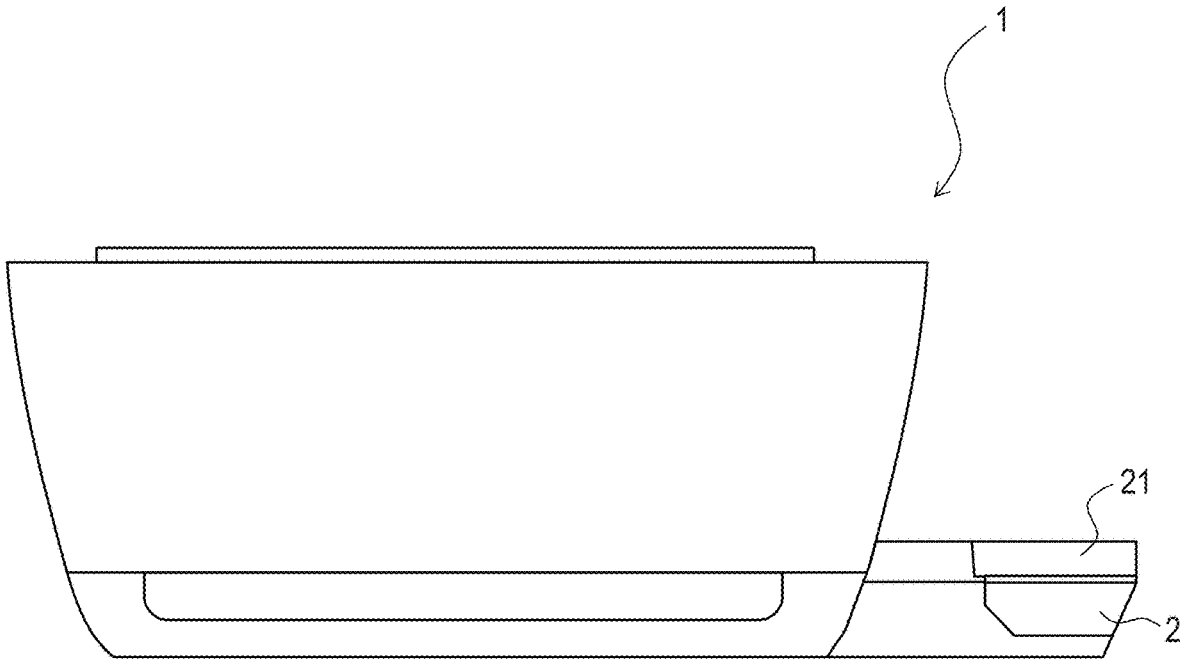
FIG. 1 is a schematic view showing a configuration example of an ink jet recording apparatus.

A configuration of an ink jet recording apparatus 1 is schematically shown in FIG. 1. The ink jet recording apparatus 1 includes a main tank 2 in a part thereof. Ink as a liquid is supplied to a recording head on a carriage that moves and scans for recording from the main tank 2 via a tube (any configurations are not shown). The main tank 2 is configured to be covered with a cover 21.

Figure 2:
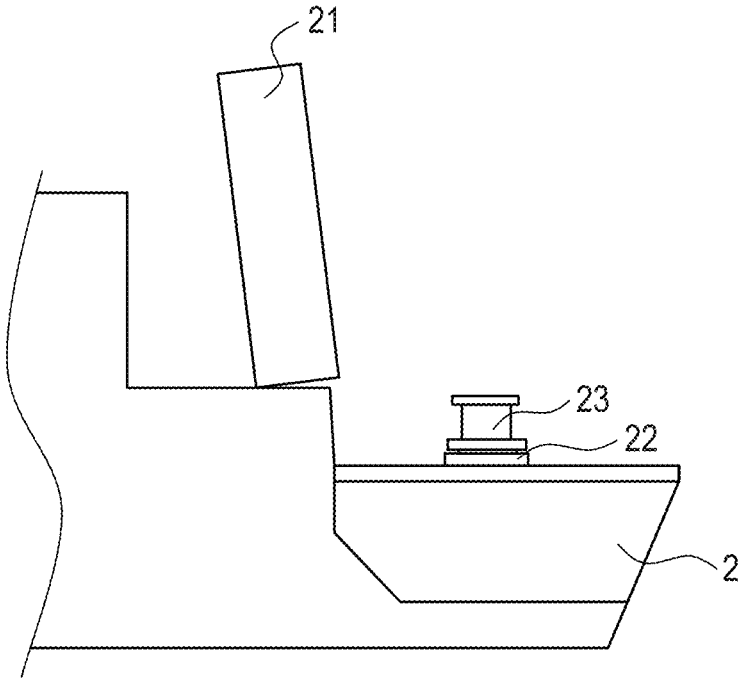
FIG. 2 is an enlarged schematic view of a main tank portion of the ink jet recording apparatus.

FIG. 2 shows an enlarged view showing a peripheral portion of the main tank 2 of the ink jet recording apparatus 1 of FIG. 1, showing a state in which the cover 21 is opened. The main tank 2 is provided with a liquid inlet 22 (hereinafter referred to as an ink inlet), and when the ink in the main tank 2 is consumed, a necessary amount of ink is replenished using a liquid replenishment container (hereinafter referred to as an ink replenishment container) that stores ink for replenishment described later.

A plug member 23 (hereinafter referred to as a plug for convenience) is attached detachably to the ink inlet 22 in order to suppress ink from leaking out or evaporating from the ink inlet 22 of the main tank 2.

Figure 3A:
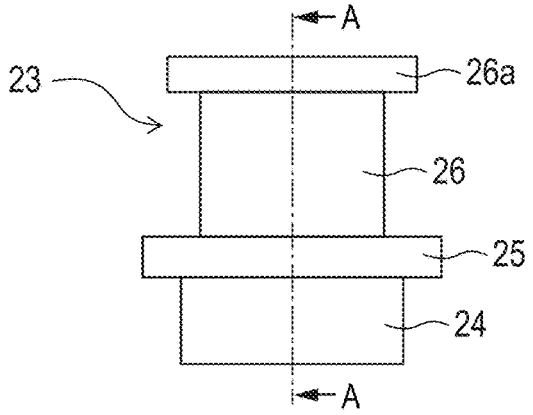
FIG. 3A is a view for explaining a configuration example of a plug member for closing an inlet of the main tank, which is a schematic side view showing an appearance of the plug member.
Figure 3B:
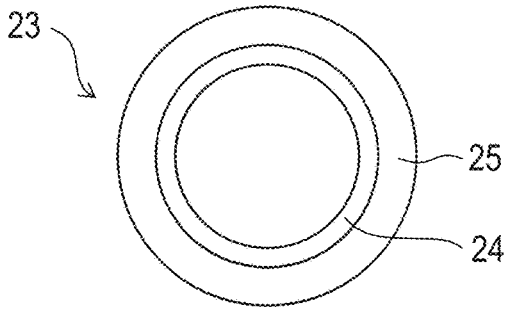
FIG. 3B is a view for explaining a configuration example of a plug member for closing the inlet of the main tank, which is a schematic bottom view of the plug member.
Figure 3C:
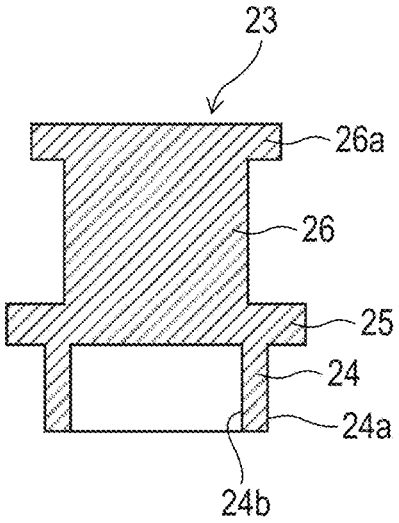
FIG. 3C is a view for explaining a configuration example of a plug member for closing the inlet of the main tank, which is a schematic sectional view shown by cutting the plug member along line A-A of FIG. 3A.

A configuration example of the plug 23 is shown in FIGS. 3A to 3C. FIG. 3A shows a side view showing an external appearance of the plug 23, FIG. 3B shows a bottom view of the plug 23, and FIG. 3C shows a sectional view by cutting the plug shown in FIG. 3A along line A-A, respectively.

As shown in FIG. 3A, the plug 23 includes a seal portion 24 that closely fits with the ink inlet 22 to seal the ink inlet 22. Also, the plug 23 includes a flange portion 25 that abuts an opening surface of the ink inlet 22 to restrict the position of the plug 23 in the ink inlet 22, and restricts further entry of the seal portion 24. Furthermore, the plug 23 is provided with a knob portion 26 so that the operator is easily operate it when attaching and removing the plug 23 to and from the ink inlet 22, and the knob portion 26 is provided with a finger hook portion 26*a* for easy finger hooking. The seal portion 24 has a cylindrical shape as shown in FIGS. 3B and 3C, and is configured by adjusting its size and the like so that an outer peripheral surface 24*a* thereof comes in close contact with the inner peripheral surface of the ink inlet 22. Further, the outer peripheral surface of a cylindrical rib provided inside the cap of the ink replenishment container described later comes in close contact with an inner peripheral surface 24*b* of the seal portion 24.

Figure 4:
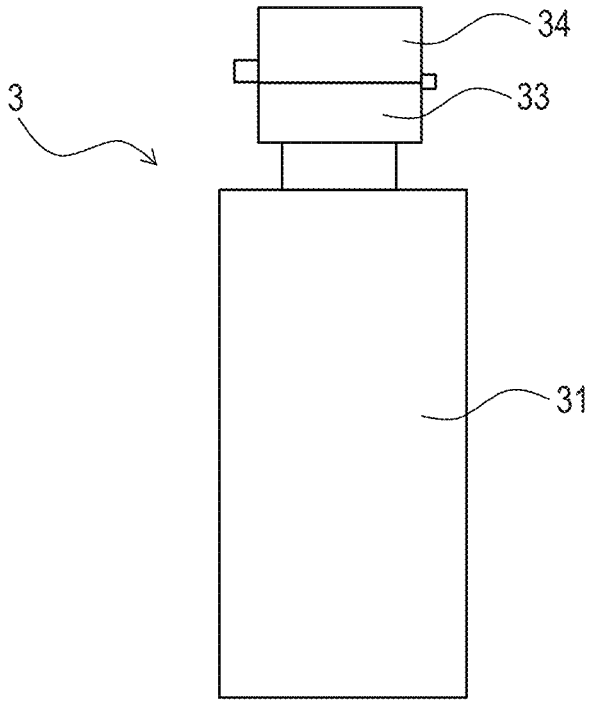
FIG. 4 is a schematic view showing an ink replenishment container according to a first embodiment.
Figure 5A:
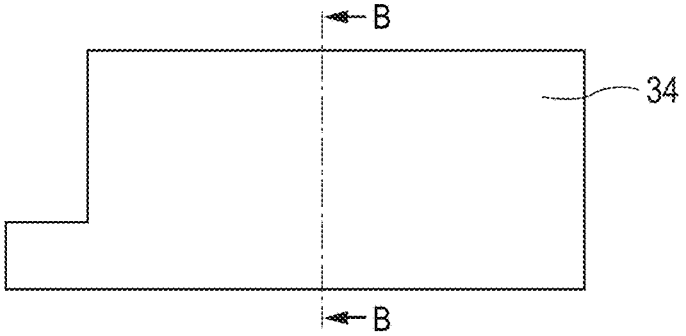
FIG. 5A is a view for explaining a cap according to the first embodiment, which is a schematic side view showing an external appearance of the cap.
Figure 5B:
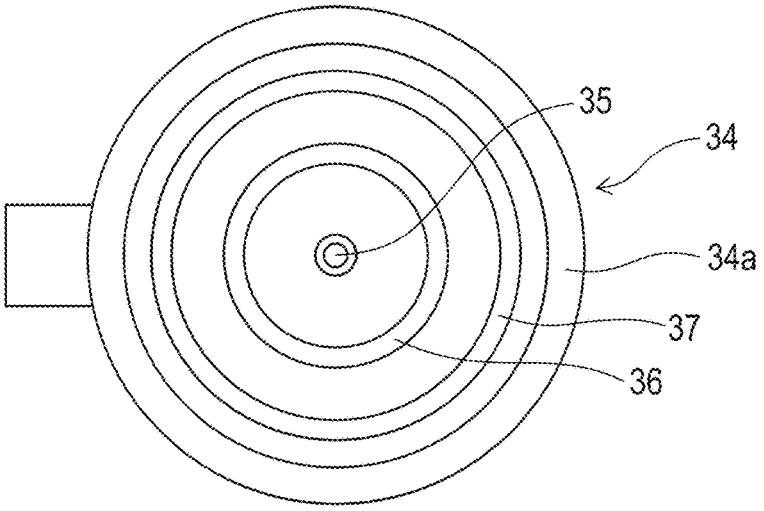
FIG. 5B is a view for explaining the cap according to the first embodiment, which is a bottom view of the cap.
Figure 5C:
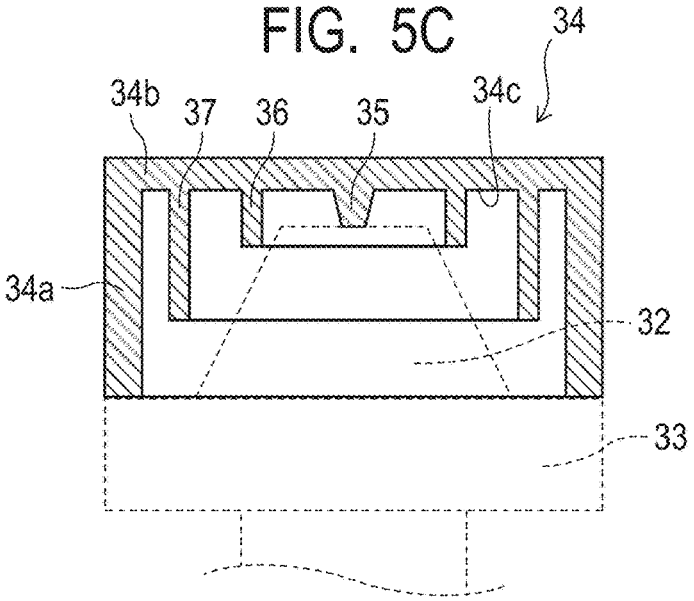
FIG. 5C is a view for explaining the cap according to the first embodiment, which is a schematic sectional view shown by cutting the cap along line B-B of FIG. 5A.

FIG. 4 is a schematic side view showing an external appearance of an ink replenishment container 3 that reserves the ink replenished to the main tank 2. FIGS. 5A to 5C show a configuration example of a cap 34 attached to the ink replenishment container 3, FIG. 5A shows a side view showing an appearance of the cap 34, FIG. 5B shows a bottom view of the cap 34, and FIG. 5C shows a sectional view by cutting the cap 34 shown in FIG. 5A along line B-B, respectively.

As shown in FIG. 4, the ink replenishment container 3 includes a container body 31 for storing ink. Then, it is configured that a nozzle base portion 33 including a liquid replenishing port 32 (hereinafter referred to as a replenishing port) (shown by virtual lines in FIG. 5C) for replenishing liquid ink is attached to the container body 31, and the main tank 2 is replenished with ink from the container body 31 via the replenishing port 32. The amount of ink stored in the ink replenishment container 3 is an amount capable of replenishing ink a plurality of times. Therefore, in the ink replenishment container 3, the replenishing port 32 is sealed by the cap 34 so that ink does not leak out or evaporate from the replenishing port 32 during preservation.

As shown in FIGS. 5A to 5C, the cap 34 is configured by a cylindrical outer peripheral surface 34*a* and a flat surface 34*b* for closing one side of the outer peripheral surface 34*a*. Moreover, as shown in FIG. 5B, at the center of an inner surface 34*c* of the cap (the inner surface of the flat surface 34*b* of the cap 34), a sealing portion 35 for sealing the opening portion of the replenishing port 32 for replenishing ink is provided. The outer peripheral surface 34*a* of the cap 34 is configured so as to function as a knob portion when the operator holds the cap 34 and performs an opening and closing operation. As shown in FIG. 5B, on the inner surface 34*c* of the cap 34, two cylindrical ribs are erected concentrically around the sealing portion 35. A rib provided near the sealing portion 35 is a first rib 36, and a rib provided between the first rib 36 and the outer peripheral surface 34*a* is a second rib 37.

The first rib 36 and the second rib 37 have different rib dimensions, and as shown in FIG. 5C, the first rib 36 is configured to be short and the second rib 37 is configured to be long. Here, as shown hypothetically in FIG. 5C, the first rib 36 is configured so that the peripheral side surface of the replenishing port 32 of the ink replenishment container comes in contact with the first rib 36 in a capped state. Thereby, sealing properties of the replenishing port 32 are secured together with the sealing portion 35. Further, it is also possible to minimize the range of staining due to the ink leaking out from the replenishing port 32.

Figure 6:
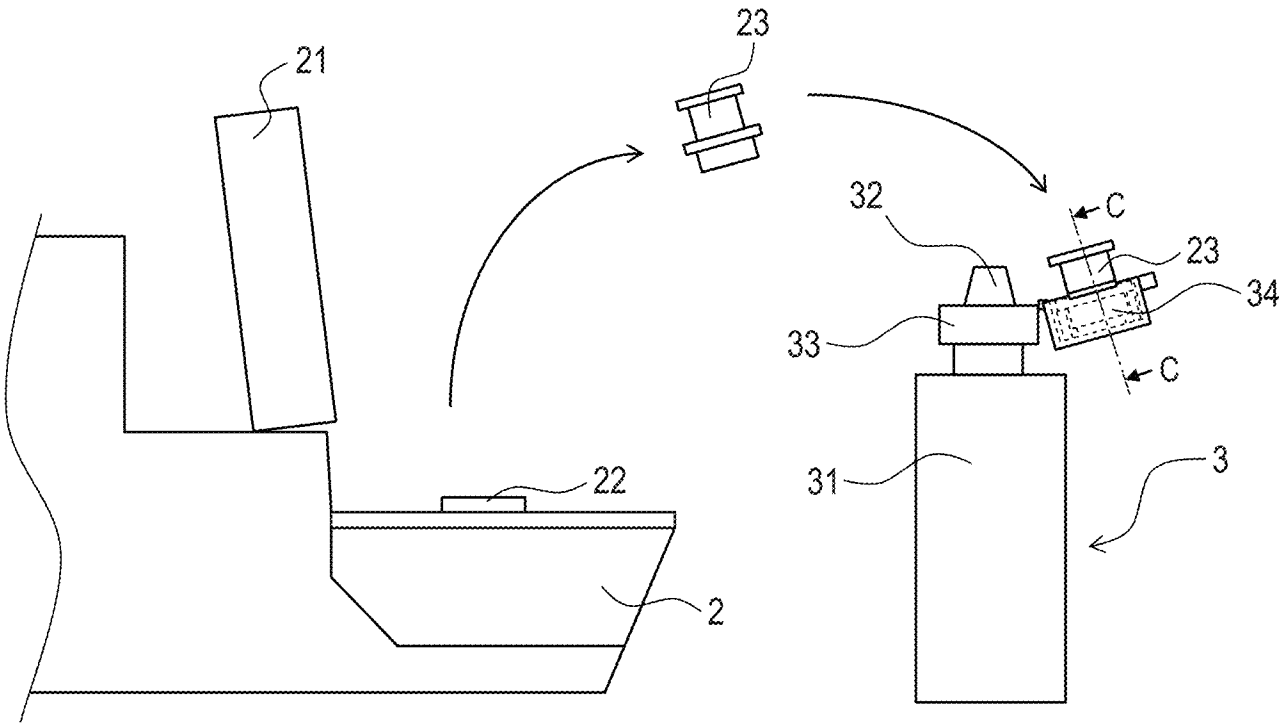
FIG. 6 is a schematic view showing a state in which the plug member is removed from the inlet of the main tank and a state in which the plug member is attached to the cap of the ink injection container.

Next, replenishment of ink will be described with reference to the drawings. As shown in FIG. 6, a liquid replenishment system including the ink jet recording apparatus 1 and the ink replenishment container 3 is configured. Then, as shown in FIG. 6, the plug 23 is removed from the main tank 2 and the cap 34 of the ink replenishment container 3 is opened. Moreover, the seal portion 24 coming in contact with the ink inlet 22 of the removed plug 23 (after removing the plug 23, the seal portion 24 that was in contact) is faced to the surface of the cap 34 covering the replenishing port 32 (after opening the cap 34, the surface that covered the replenishing port 32). After the seal portion 24 is faced to the surface of the cap 34 covering the replenishing port 32, the plug 23 is inserted into the inner surface 34*c* of the cap 34, and both are housed in a stack. The configuration including the ink jet recording apparatus 1 and the ink replenishment container 3 in this manner is referred to as a liquid replenishment system. A cross section by cutting along line C-C of FIG. 6 is shown in FIG. 7.

Figure 7:
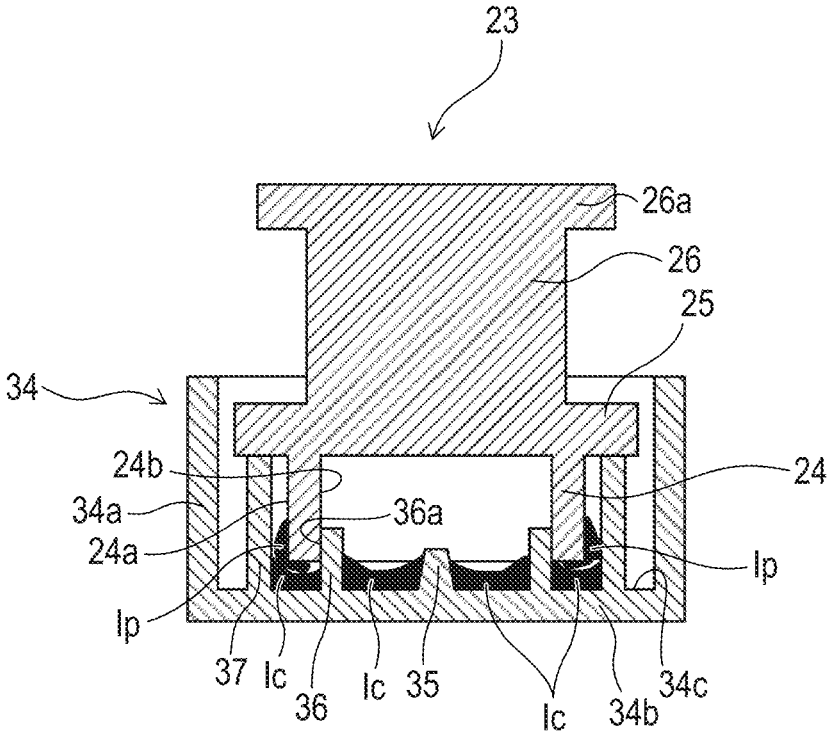
FIG. 7 is a schematic sectional view shown by cutting the cap portion to which the plug member of FIG. 6 is attached, along line C-C of FIG. 6.

As shown in FIG. 7, the cap 34 and the plug 23 are arranged such that an area (Ic) stained with ink on the inner surface 34*c* of the cap and an area (Ip) stained with ink of the seal portion 24 of the plug 23 are superposed to face each other. The cap 34 is attached so that the seal portion 24 of the plug 23 is covered by the outer peripheral surface 34*a* of the cap 34. Then, the inner peripheral surface 24*b* of the seal portion 24 of the plug 23 comes into contact with an outer peripheral surface 36*a* of the first rib 36 of the cap 34 and is pressed, whereby the plug 23 is attached to the cap 34, and it is configured that the plug 23 does not easily come off from the cap 34.

Figure 8:
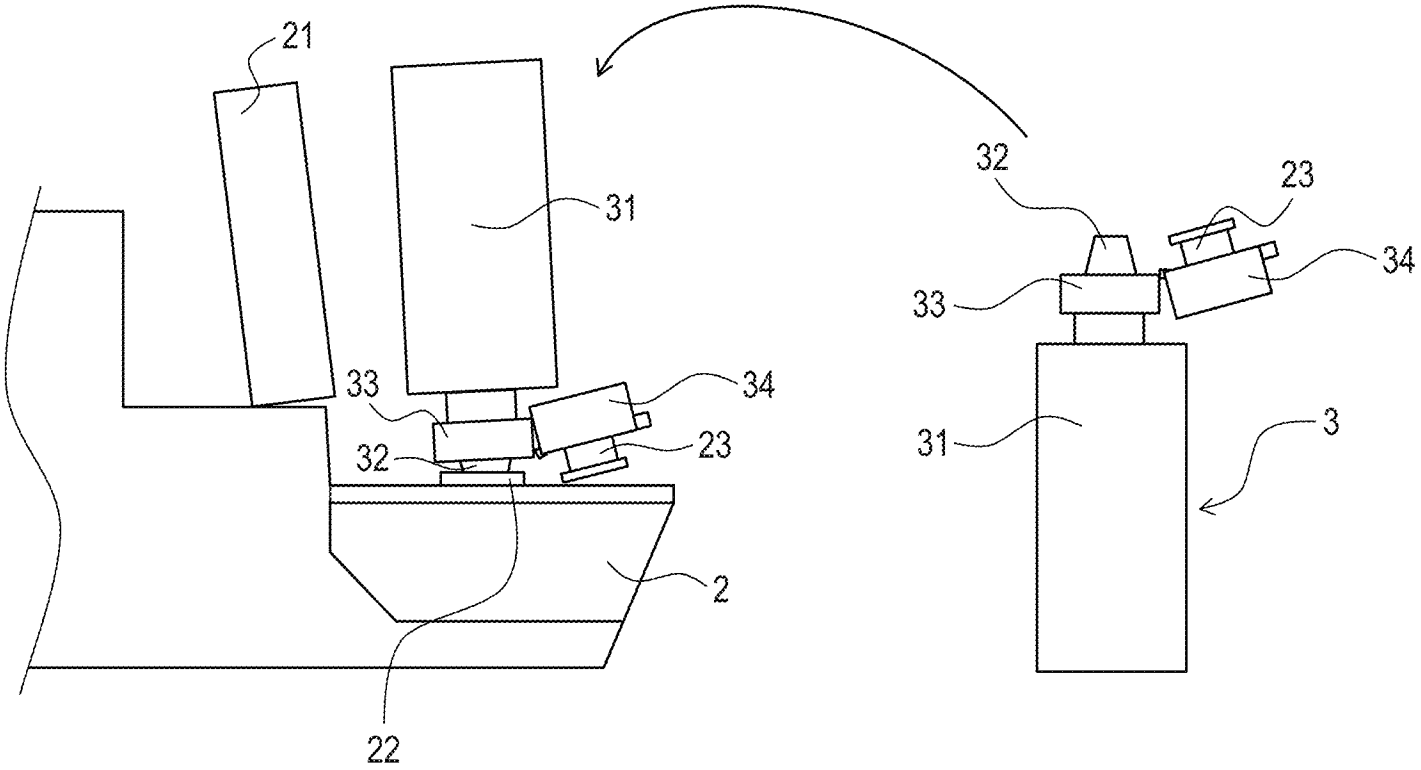
FIG. 8 is a schematic view showing an ink replenishment state.

As shown in FIG. 8, the periphery of the sealing portion 35 assumed to be most stained with ink is located inside the seal portion 24 of the plug 23, so that leakage of the ink from the inside of the cap 34 to the outside is restricted. The flange portion 25 of the plug 23 and the tip of the second rib 37 of the cap 34 abut each other, and intrusion of the plug 23 into the cap 34 is restricted. Further, since the flange portion 25 of the plug 23 and the tip of the second rib 37 of the cap 34 abut each other to constitute a closed space, leakage of the ink present inside these areas (Ic, Ip) to the outside is restricted.

As described above, no ink leakage and no new ink adhesion surface or contaminated part are generated in the cap 34 or the plug 23, so that even when the plug 23 is removed from the cap 34 and the ink inlet 22 is plugged again, the fingers of the operator and the like are not contaminated with ink. Even when the cap 34 is put on the ink replenishment container 3, the periphery of the cap and the fingers of the operator are not stained. Therefore, occurrence of contamination by ink can be satisfactorily suppressed even when an ink replenishing operation is repeatedly performed.

As shown in FIG. 8, replenishment of ink in the ink replenishment container 3 to the main tank 2 is performed by inserting the replenishing port 32 of the ink replenishment container 3 into the ink inlet 22. At this time, as shown in FIG. 7, ink stain in the cap 34 and ink stain of the plug 23 are present in the closed spaces constituted by the flange portion 25 and the second rib 37, and the seal portion 24 and the first rib 36. Therefore, as shown in FIG. 8, even when the ink replenishment container 3 is in an upside-down position to replenish ink, ink does not leak to the outside from the cap 34, and the top surface of the main tank 2 and the surroundings thereof, or the fingers and clothes of the operator and the like are not stained. Further, since a configuration in which the cap 34 is connected to the ink replenishment container 3 by a hinge is adopted in this configuration example, loss of the cap 34 and loss of the plug 23 attached to the cap 34 can be also prevented. Of course, even in a configuration in which the cap 34 is not connected to the ink replenishment container body 31, the problem of stain with ink does not occur when this configuration is applied.

Furthermore, even when the plug 23 is forgotten to return to the ink inlet 22 after the completion of the ink replenishment operation, the presence of the plug 23 can be noticed when the replenishing port 32 of the ink replenishment container 3 is closed by the cap 34. Therefore, it is possible to prevent forgetting to return the plug 23 to the ink inlet 22.

Second Embodiment

Figure 9:
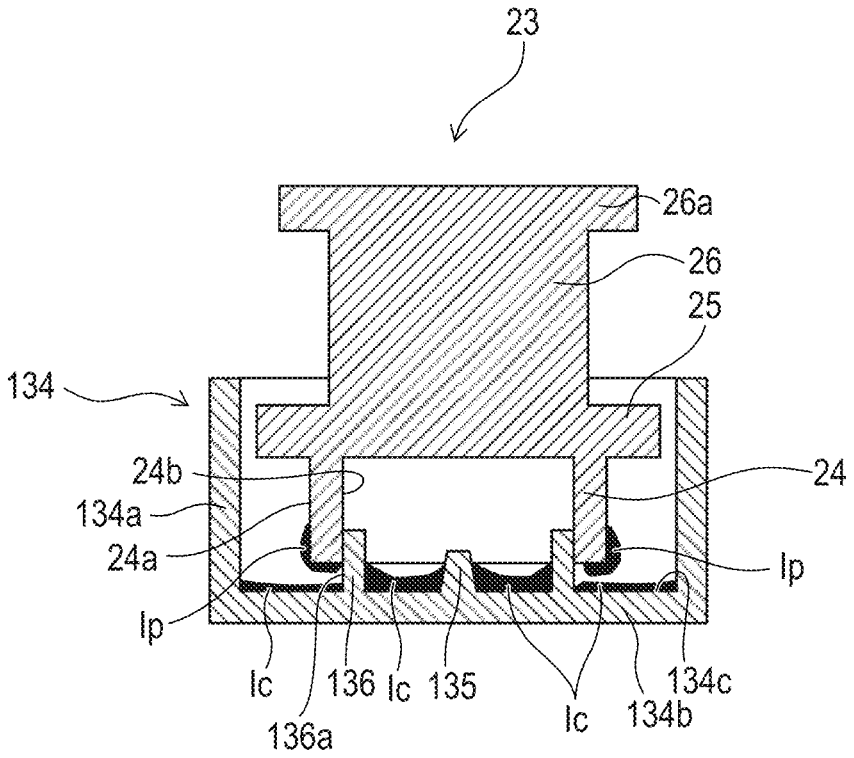
FIG. 9 is a schematic view showing a second embodiment, which is a schematic sectional view shown by cutting the plug member in a state attached to the cap.

A second embodiment is shown in FIG. 9. FIG. 9 is a sectional view of a state in which a plug is attached to a cap as in FIG. 7. The configuration of a cap 134 shown in FIG. 9 does not have a structure corresponding to the second rib with respect to the configuration of the cap 34 shown in FIG. 7. As shown in FIG. 9, it is the same as the configuration of FIG. 7 in that the cap 134 and the plug 23 are arranged such that an area (Ic) stained with ink on the inner surface 134*c* of the cap 134 and an area (Ip) stained with ink of the seal portion 24 of the plug 23 are superposed to face each other. In this configuration, it is configured that the seal portion 24 of the plug 23 is covered with an outer peripheral surface 134*a* of the cap 134.

The inner peripheral surface 24*b* of the seal portion 24 of the plug 23 is pressed into an outer peripheral surface 136*a* of a first rib 136 of the cap 134, whereby the plug 23 is attached to the cap 134. Thereby, the configuration in which the plug 23 is not easily pulled out from the cap 134 is the same as the configuration of FIG. 7. In this configuration, since the periphery of a sealing portion 135 assumed to be most contaminated with ink is located inside the seal portion 24 of the plug 23, leakage of the ink from the inside of the cap is restricted. However, there is a possibility that the ink (Ip) adhering to the periphery of the seal portion 24 of the plug 23 drips down between the first rib 136 and the outer peripheral surface 134*a* of the inner surface 134*c* of the cap, but the amount is small, and a possibility of dropping out of the cap 134 is low. Therefore, even in the configuration shown in FIG. 9, it is possible to suppress ink contamination due to ink leakage.

In the configuration of the plug 23 shown in FIGS. 7 and 9, the cap 134 is configured as a separate body from the ink replenishment container 3, and is not connected, whereas the knob portion 26 of the plug 23 protrudes out. Therefore, it is unstable to place the cap with the plug 23 directed downward (place the cap with the opening of the cap directed downward) and it is a stable to place the cap with a flat surface 134*b* of the cap directed downward, so in this state, it is possible to prevent from constituting a state where ink leaks out.

Figure 10:
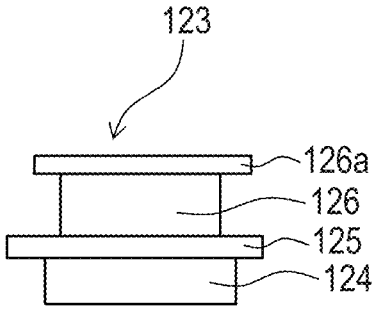
FIG. 10 is a schematic view showing another configuration example of the plug member.

As another configuration of the plug 23, as shown in FIG. 10, a configuration in which the length of the knob portion 126 of the plug 123 is shorter than the length of the knob portion 26 of the plug 23 shown in FIGS. 3A to 3C may be used. With this configuration, the amount of protrusion of the plug 123 attached to the cap 34 when replenishing ink to the main tank 2 as shown in FIG. 8 is extremely small, so that interference between the plug 123 and the upper surface of the main tank 2 can be suppressed to the minimum. As a result, the posture of the ink replenishment container 3 when replenishing ink can be made more stable.

Third Embodiment

Figure 11:
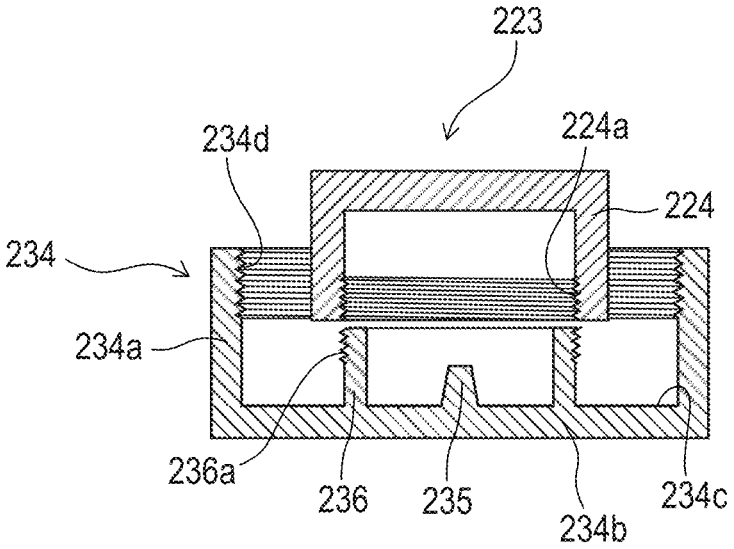
FIG. 11 is a schematic view showing a third embodiment, which is a sectional view shown by cutting the plug member in a state immediately before attached to the cap.

Another configuration example of a coupling between a cap and a plug is shown in FIG. 11. While mutual attachment is executed by fitting in the first embodiment and the second embodiment, the configuration of attachment is not limited to fitting, and may be executed by screwing. FIG. 11 shows an example of a configuration performed by screwing. In this configuration, a configuration in which a plug 223 is screwed to the main tank 2 is adopted, and a cap 234 is also configured to be screwed to the ink replenishment container 3.

While FIG. 11 is a view showing a state in which the cap 234 and the plug 223 are not mounted, a screw portion 224*a* on the inner side of a seal portion 224 of the plug 223 and a screw portion 236*a* on the outer side of a first rib 236 of the cap 234 are screwed together so that both are attached. As shown in FIG. 11, a screw portion 234*d* is configured on the inner surface of an outer peripheral surface 234*a* of the cap 234 so as to be attached by screwing. However, regarding the attachment of the cap to the ink replenishment container, a configuration by press fitting that is the same as the configuration of FIG. 7 or the like may be adopted.

In any of the embodiments, whereas the plug continues to be used until the ink jet recording apparatus is discarded, the ink replenishment container is configured to be discarded when it finishes replenishing the stored ink to the main tank. Therefore, it can be said that it is more preferable configuration to adopt a configuration in which the ink adhered to the plug is positively adhered to the cap side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-226896, filed Nov. 27, 2017, which is hereby incorporated by reference herein in its entirety.

What is claimed is:

1. A liquid replenishment container comprising:

a container body containing a liquid with which a liquid reservoir container is replenished, the liquid reservoir container being provided with a liquid reservoir portion, a circular-shaped liquid inlet port and a plug member, wherein the liquid reservoir portion is constructed to be provided to a liquid ejection recording apparatus and to reserve the liquid to be supplied to a recording head that ejects the liquid, the liquid inlet port is configured to enable the liquid reservoir portion to be replenished with the liquid from the outside, and the plug member is provided with a seal portion, a flange portion and a knob portion, the seal portion having an outer diameter of which value is same as that of an inner diameter of an opening of the liquid inlet port, the flange portion having a diameter larger than the inner diameter of the opening, the knob portion extending from the flange portion;

the liquid replenishment container further comprising:

a liquid replenishing port constructed for insertion into the liquid inlet port to replenish the liquid reservoir container with the liquid through the liquid inlet port from the container body; and a cap with a cylindrical shape of which one end is closed and the other end is open, the cap being configured to be detached from the liquid replenishing port at the time of replenishing and to be attached to the liquid replenishing port at the time of storing the liquid;

wherein the cap is provided with a sealing portion, an outer peripheral surface, and a cylindrical-shaped first rib inside thereof, the sealing portion sealing the replenishing port, the outer peripheral surface covering the surroundings of the replenishing port while abutting on the container body, and the first rib having an inner peripheral surface abutting on the surroundings at the vicinity of the tip of the replenishing port, and the cap is configured so that when the plug member is housed in the cap with the seal portion side of the plug member facing an opening side of the cap, an outer periphery of the first rib attaches to an inner periphery of the seal portion of the plug member.

2. The liquid replenishment container according to claim 1, wherein the cap is provided with a cylindrical-shaped second rib having a diameter larger than the diameter of the first rib and being longer than the first rib, and an end portion of an opening side of the second rib is configured to abut on the flange portion.

3. The liquid replenishment container according to claim 1, wherein a first screw portion is provided on an inner peripheral surface of the seal portion, the first screw portion being configured to screwing to the liquid inlet port, a second screw portion is provided on an outer peripheral surface of the first rib, the second screw portion being configured to screwing to the first screw portion, and the plug member and the cap are configured to be superposed by screwing the first screw portion and the second screw portion each other.

4. A liquid replenishment container according to claim 1, wherein the cap is disconnectably connected to the container body.

5. A liquid replenishment container according to claim 1, wherein the cap is completely removable from the container body.

6. A liquid replenishment system comprising:

a liquid reservoir container provided with a liquid reservoir portion, a circular-shaped liquid inlet port and a plug member, wherein the liquid reservoir portion is constructed to be provided to a liquid ejection recording apparatus and to reserve the liquid to be supplied to a recording head that ejects the liquid, the liquid inlet port is configured to enable the liquid reservoir portion to be replenished with the liquid from the outside, and the plug member is provided with a seal portion, the seal portion having an outer diameter of which value is same as that of an inner diameter of an opening of the liquid inlet port;

the liquid replenishment system further comprising:

a liquid replenishment container provided with a container body, a liquid replenishing port and a cap with a cylindrical shape of which one end is closed and the other end is open;

wherein the container body is constructed to contain the liquid with which the liquid reservoir container is replenished, the liquid replenishing port is constructed for insertion into the liquid inlet port to replenish the liquid reservoir container with the liquid through the liquid inlet port from the container body, the cap is configured to be detached from the liquid replenishing port at the time of replenishing and to be attached to the liquid replenishing port at the time of storing the liquid;

the cap is provided with a sealing portion, an outer peripheral surface, and a cylindrical-shaped first rib inside thereof, the sealing portion sealing the liquid replenishing port, the outer peripheral surface covering the surroundings of the liquid replenishing port while abutting on the container body, and the first rib having an inner peripheral surface abutting on the surroundings at the vicinity of the tip of the liquid replenishing port, and the cap is configured so that when the plug member is housed in the cap with the seal portion side of the plug member facing an opening side of the cap, an outer periphery of the first rib attaches to an inner periphery of the seal portion of the plug member.

7. The liquid replenishment system according to claim 6, wherein the plug member is provided with a flange portion and a knob portion, the flange portion having a diameter larger than the inner diameter of the opening, the knob portion extending from the flange portion, and the cap is provided with a cylindrical-shaped second rib having a diameter larger than the diameter of the first rib and being longer than the first rib, and an end portion of an opening side of the second rib is configured to abut on the flange portion.

8. The liquid replenishment system according to claim 6, wherein a first screw portion is provided on an inner peripheral surface of the seal portion, the first screw portion being configured to screwing to the liquid inlet port, a second screw portion is provided on an outer peripheral surface of the first rib, the second screw portion being configured to screwing to the first screw portion, and the plug member and the cap are configured to be superposed by screwing the first screw portion and the second screw portion each other.

* * * * *